United States Patent [19]

Smith

[11] 4,127,367

[45] Nov. 28, 1978

[54] ROTARY MECHANISM WITH RESILIENT DRIVE MEANS

[76] Inventor: Russell I. Smith, 668 Rochdale Cir., Lombard, Ill. 60148

[21] Appl. No.: 785,305

[22] Filed: Apr. 6, 1977

[51] Int. Cl.[2] ..... F03C 3/00

[52] U.S. Cl. ..... 418/36; 418/35

[58] Field of Search ..... 418/33, 35, 36, 37, 418/38; 123/8.47, 245

[56] References Cited

U.S. PATENT DOCUMENTS

| | | | |
|---|---|---|---|
| 386,479 | 7/1888 | Low et al. | 418/37 |
| 728,536 | 5/1903 | Breed et al. | 418/35 |
| 813,974 | 2/1906 | King | 418/33 |
| 1,458,641 | 6/1923 | Cizek | 418/38 X |
| 1,568,051 | 1/1926 | Bullington | 418/36 X |
| 2,943,609 | 7/1960 | Griem | 418/33 X |
| 3,175,467 | 3/1965 | Mallinckrodt | 418/38 |
| 3,227,090 | 1/1966 | Bartolozzi | 418/35 |
| 3,555,813 | 1/1977 | Bancroft | 418/37 X |

*Primary Examiner*—Carlton R. Croyle
*Assistant Examiner*—Leonard E. Smith

[57] ABSTRACT

A rotary motor including a pair of concentric vaned elements alternately rotating to drive a continuously revolving output shaft by means of a resilient drive in an efficient and balanced manner including means to hold each of the rotary elements against relative reverse rotation as the device is operating and having a planetary gear mechanism to provide reduced drive ratio to the output shaft.

10 Claims, 7 Drawing Figures

10
12
20
24
2
3
22
102a
102
100a
52
100
52a
62
68
74
72
45
14
72a
64
66
70
28
106a
58
28a
36
45
56
54
108a
16
60
18
30

100
12
102
74
14
68
72
58

104
108
46
106
48
64
56
42
28
45
44
32
26
26
32
80
82

ROTARY MECHANISM WITH RESILIENT DRIVE MEANS

SUMMARY OF THE INVENTION

In the past there have been many attempts to provide a balanced and efficient rotary type of fluid motor or engine to provide a drive to an output shaft. The present invention includes a rotary fluid motor having a pair of vaned elements which are concentric and are driven alternatively in a forward direction to provide a smooth drive connection to an output shaft by means of a resilient drive connection. There is provided automatic reaction means to prevent a reverse relative rotation of one of the rotating elements at the proper time such that the entire mechanism provides a smooth and balanced rotary drive which will be operative to transfer driving torque to an output shaft from a fluid pressure source. In the alternative, the structure described and disclosed herein can be converted to an internal combustion engine by providing spark plugs or spark ignition mechanism for the fluid chambers of the devices disclosed.

DESCRIPTION OF THE DRAWINGS

The preferred form for the present invention is illustrated in the accompanying drawings wherein.

DETAILED DESCRIPTION

Figure 1:
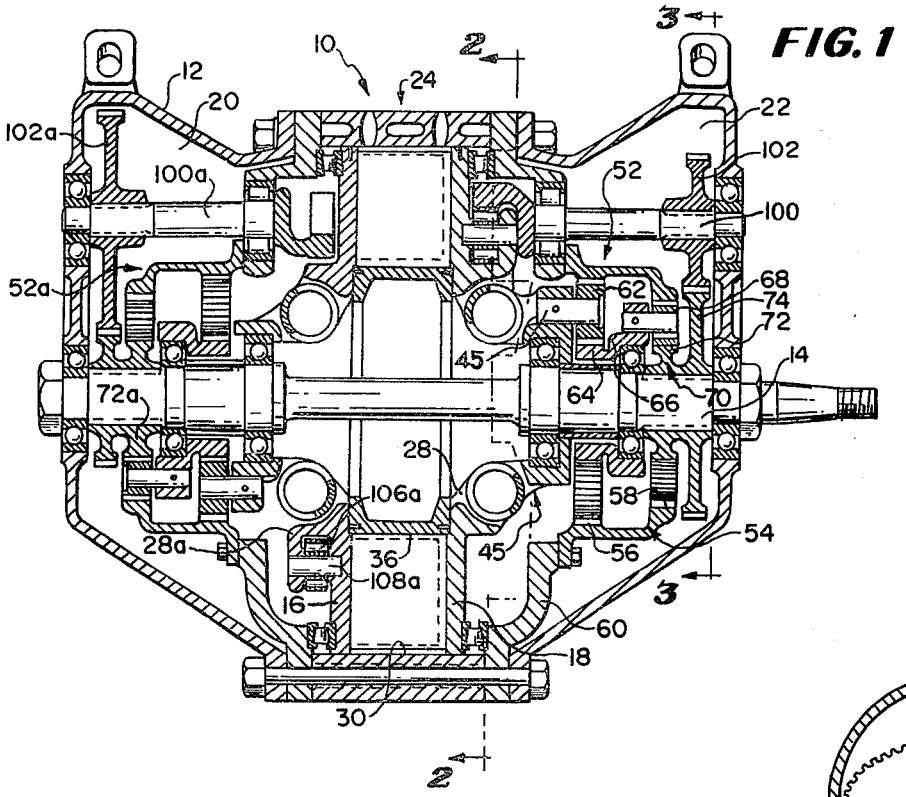
FIG. 1 is a cross-sectional view through a rotary engine incorporating the principles of the present invention.
Figure 3:
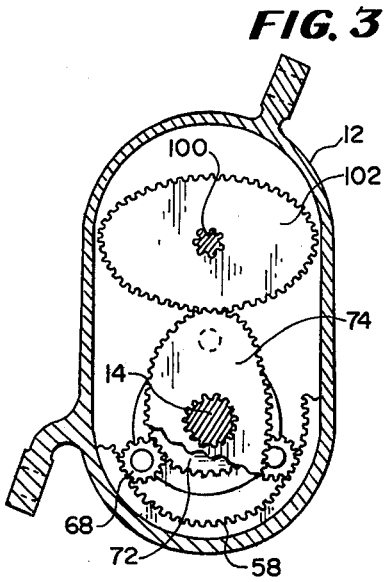
FIG. 3 is a sectional view taken along the lines of 3—3 of FIG. 1.
Figure 2:
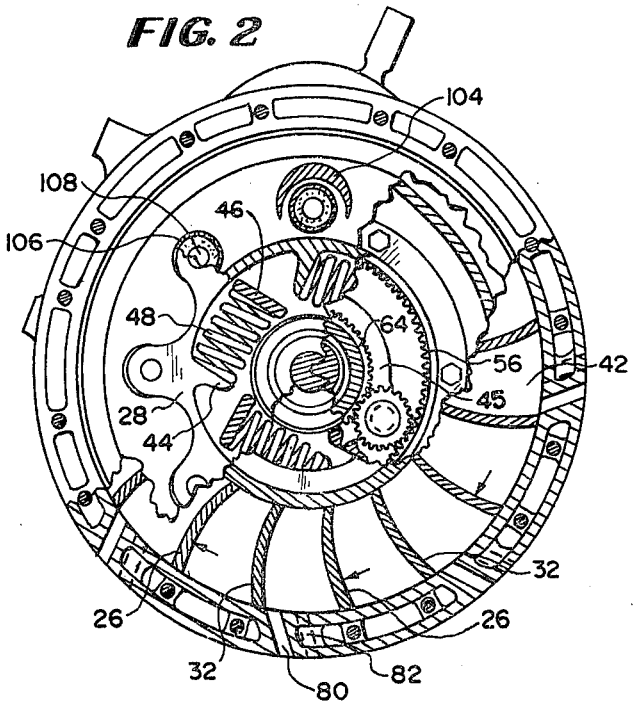
FIG. 2 is a sectional view taken along the lines of 2—2 of FIG. 1 and having certain parts broken away for clarity.

Referring to FIGS. 1-3 there is shown an improved form of fluid motor or engine 10 of the rotary type. The engine 10 in general comprises a casing 12 having mounted therein an output shaft 14. A pair of rotary vaned elements 16 and 18 are shown mounted for rotation within the casing as will be described. The casing has two gear sections 20 and 22 as illustrated and a fluid motor section 24. The gear sections 20 and 22 each include a gearing mechanism for transfer of drive from the vaned rotary elements to the output shaft 14. The elements within the motor section 24 and gear section 22 will be described; the elements in the gear section 20 being identical to those in section 22.

Element 18, for example, includes a plurality of vanes 26 thereon and has a reaction hub 28 on the inner diameter thereof. The element 18 has an external diameter mounted within cylindrical surface 30 of casing 12 and provides therebetween a relatively tight fluid seal to confine gas pressures within the areas of the vanes. The rotary element 16 includes a plurality of vanes 32 which are interspersed between the vanes 26 of element 18 as the device is mounted within the casing 12. The external diameter of the rotary element 16 also engages internal surface 30 of the casing to provide a fluid seal therebetween. Internal of the rotary elements 16 and 18 is a cylindrical rotary member 36 which is mounted within the internal diameter of the vaned elements 16 and 18 and may rotate relative thereto, the element 36 being closely fitted to the mating surfaces of the rotary elements 16 and 18.

The rotary vaned elements 16 and 18, surface 30, and the inner cylindrical element 36 define a plurality of pressure and exhaust chambers 42 within the rotary motor 24. Since there are eight vanes on each of the rotary elements 16 and 18 interfitted, sixteen chambers 42, for example, are provided between the vanes.

The hub 28 of the rotary element 18 has a plurality of driving members or surfaces 44 thereon which are adapted to drive a drive member 45 through a plurality of coil springs 48. There may, for example, be four drive members 46 on member 45 driven by springs 48.

Within the gear section 22 is a planetary transmission 52 adapted to transfer drive from rotary element 18 to output shaft 14. The transmission 52 includes a stationary member 54 having ring gears 56 and 58 thereon. The stationary member 54 is bolted to a stationary baffle 60 which is secured within the casing 12. A plurality of planetary pinions 62 are provided and mounted on a drive member 45. A sun gear element 64 is provided meshing with planetary pinions 62, planetary pinions 62 meshing with ring gear 56. Sun gear element 64 is integral with and connected to a planetary carrier 66 which has mounted thereon a plurality of pinion gears 68. A double gear member 70 is provided having a sun gear 72 and reaction gear 74 thereon. Planetary pinions 68 mesh with stationary ring gear member 58 and sun gear 72. The sun gear 72 and reaction gear 74 are drivingly connected to shaft 14 to thereby serve as a driving output to shaft 14. The operation is such that when drive member 45 is driven by rotary element 18, sun gear 64 will be driven in the same direction at a reduced drive ratio and will drive planetary carrier 66 which will drive sun gear 72 likewise in the forward direction at a further reduced ratio to provide a reduced drive ratio to shaft 14.

Provided in the casing 12 are a plurality of pressure input ports 80 which may be "eight" in number and a plurality of exhaust ports 82 which may be "sixteen" in number. The chambers 42, as the vaned elements 18 and 16 are rotating, are alternately exhaust or pressure chambers as will be further explained.

A reaction mechanism is provided for preventing backward relative rotation of one of the vaned elements 16 and 18 when the pressure pulses are received within alternative chambers 42 from the gas pressure input 80. The reaction mechanism includes a rotary reaction shaft 100 having a gear 102 thereon elliptical in shape and engaging with the elliptical gear 74 on shaft 14. Thus, gear 74 will rotate with output shaft 14 and drive gear 102 at varing speeds of rotation due to the configuration of the elliptical gears. Reaction shaft 100 has a holding means or reaction crescent 104 thereon rotating with reaction shaft 100. Mounted within the reaction hub 28 of the rotary element 18 is a plurality of cam rollers 106 rotably mounted on pins 108. The rollers 106 can be received within the reaction crescent 104 as shown in FIG. 2.

Certain of the elements is section 20 are numbered and have the same number as like elements in section 22 with the addition of the suffix "A". Rotary element 16 also includes a central reaction hub 28A and has mounted therein a plurality of rollers 106A mounted on pins 108A. The remaining elements in gear section 20 are identical to those in gear section 22. For reasons which will be described, the reaction mechanisms, including shafts 100 and the rollers 106 for the rotary elements 18 and 16, are 180° out of phase.

The operation of the fluid motor described above and as shown in FIGS. 1, 2 and 3 is that when pressure is received within all of the chambers which would be "eight" in number, which are opposite the input passages 80, the vane just to the left thereof will be driven in a clock-wise direction, for example, by the pressure of the compressed gases received through input passage 80. This gas pressure will produce a reaction force upon the vanes 26, for example, thereby tending to move the vanes 26 and rotary element 18 relatively in the counter-clockwise direction. However, at this time, the reaction mechanism comprising the crescent 104 will be in a position about 150° opposite to that illustrated in FIG. 2, holding the rotary element 18 from rotating in the reverse direction due to engagement between crescent 104 and roller 106. As will be apparent, the timing of the rotation of cresent 104 is critical and this timing is provided by the drive from output shaft 14 through elliptical gears 74 and 102 such that at the proper position of rotary element 18 with respect to the input passages 80, the crescent 104 will block reverse rotation of the reaction hub 28 on which rollers 106 are mounted. The forward drive of the output shaft 14 is provided, as for example, when the rotary element 18 would be in position to be driven by the expanding gas pressure within alternate chambers 42 and will drive member 45 and through the double-planetary reduction gear set will drive sun gear 72 and output shaft 14 in the same direction as rotary element 18 at a reduced ratio. As will be apparent when one of the rotors is driving in a forward direction, the other rotor is in its reaction phase, momentarily stationary with respect to the other rotor and held by crescent 104. In addition, as eight of the alternating chambers 42 receive a pressure pulse and eight vanes are moved in a forward direction, the exhaust passages 82 will be positioned to conduct exhaust gases or expended gas from the other eight alternating chambers 42. As will be apparent, a valve system must be provided to alternatively open pressure to the input passages 80 and allow escape of pressure from the exhaust passages 82, which can be accomplished in a known manner and will not be described in detail herein.

From the above, it will be apparent that the present inventive rotary fluid motor, provides an efficient driving of a shaft 14 in a balanced rotary manner to provide a smooth drive from a fluid pressure source. The reaction mechanisms for the rotary elements 16 and 18 are 180° out of phase to add to the balanced nature of the fluid motor.

As will be apparent with the use of the valves to alternately open and close the input and exhaust passages 80, 82, and with the addition of spark plugs at the proper locations, the fluid motor 110 can be easily converted from an external combustion motor or engine, for example, to an internal combustion engine to provide a drive of an output shaft 14.

Figure 4:
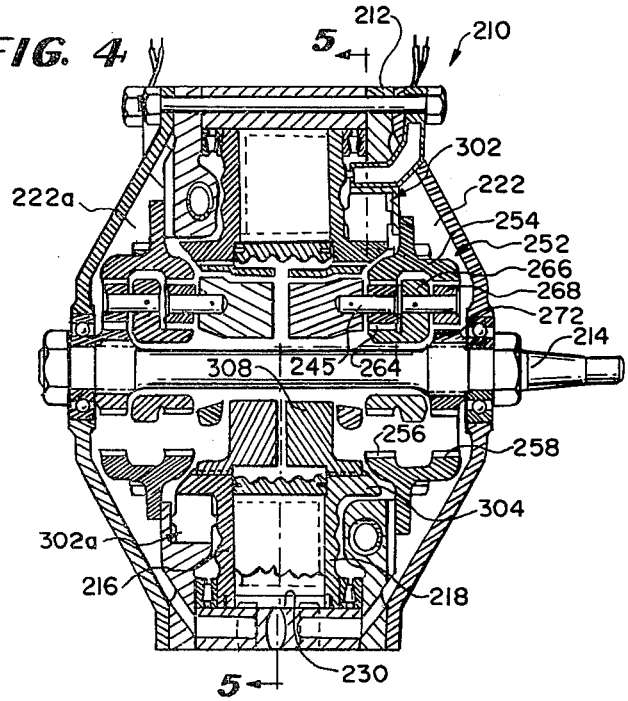
FIG. 4 is a cross-sectional view through a modified form of the invention of FIG. 1.
Figure 5:
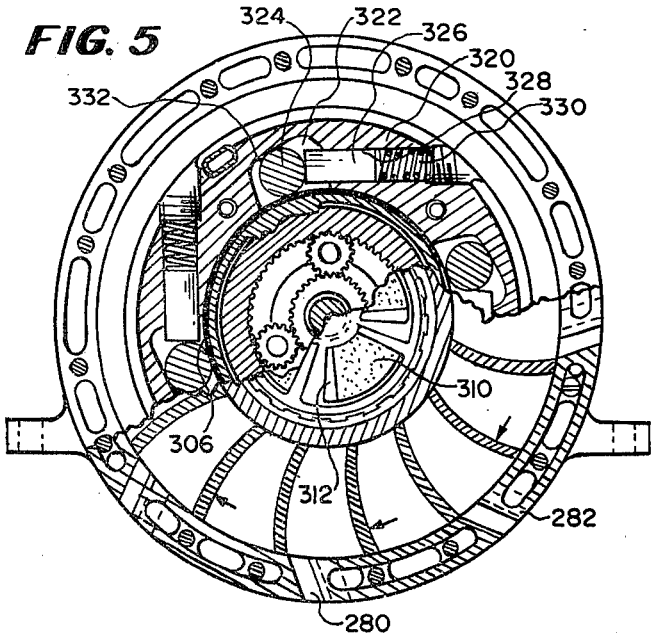
FIG. 5 is a cross-sectional view with certain parts broken away for clarity taken along the lines 5—5 of FIG. 4.

Referring to FIGS. 4 and 5 a modified form of rotary motor is disclosed. Elements of this embodiment similar to elements of FIGS. 1, 2 and 3 are labelled with the same numbers with the addition of the prefix "2", i.e., the numbers in the 200 series being similar to those of FIG. 1. The major difference between the embodiment of FIG. 4 and that of FIGS. 1–3 is the reaction mechanism for the rotors 216–218 when they are acting as a reaction member as the other rotor is being driven in a forward direction. The description of the drive through planetary gear mechanism 252 will not be described, since that is identical to that described for FIG. 1. Likewise, the action of the fluid drive through the passages 280 and from the exhaust passages 282 will not be described since it is identical. The reaction mechanism for the structure of the form of fluid motors shown in FIGS. 4 and 5 comprises a relatively large one-way clutch mechanism 302 which serves to automatically hold the rotary elements 216–218 against rotation in the reverse direction to that which they are normally driven.

Element 218, for example, includes an axial hub 304 which defines thereon an internal race 306 for one-way clutch 302. The hub 304 is drivingly connected to a drive hub 308 which drives, through resilient segments 310, drive lugs 312 on the planetary carrier 250.

Provided within casing 212 is a reaction plate 320 for one-way clutch 302. Reaction plate 320 includes a series of slots 322 in which are mounted rollers 324. The rollers 324 are engaged by bars 326 mounted in bores 328 in reaction plate 320. A coil spring 330 engages each of the bars 326, urging same to the left, for example, as illustrated in FIG. 5 to hold the roller 324 in an engaged position between the inner race 306 and an external cam surface 332 provided in the grooves 322. Thus, as will be clear since reaction plate 320 is stationary, if the hub 306 attempts to rotate in the counter-clockwise direction, it will not be able to since this will force the rollers 324 into tighter engagement with cam 332 and hold the inner race 306 stationary. However, the race 306 can rotate in the clockwise direction since this tends to move the rollers 324 out of their wedging engagement between cam surfaces 332 and race 306. A similar one-way mechanism or clutch 302A is provided for the gear section 222A and likewise would serve to hold rotary element 216 against movement in the counter-clockwise direction in a like manner to that provided by one-way clutch 302 for rotary element 218. Thus, in the embodiment of FIGS. 4 and 5 a simplified form of reaction mechanism is provided to hold the rotors 216 and 218 against rotation in the reverse direction automatically when they are acting as the reaction member for the fluid drive through the motor 210.

Figure 6:
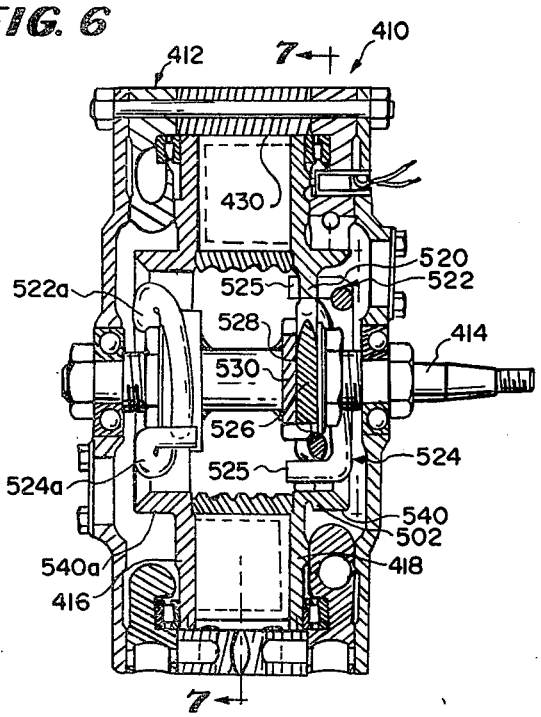
FIG. 6 is a cross-sectional view of a further modified form of fluid motor of the type disclosed herein.
Figure 7:
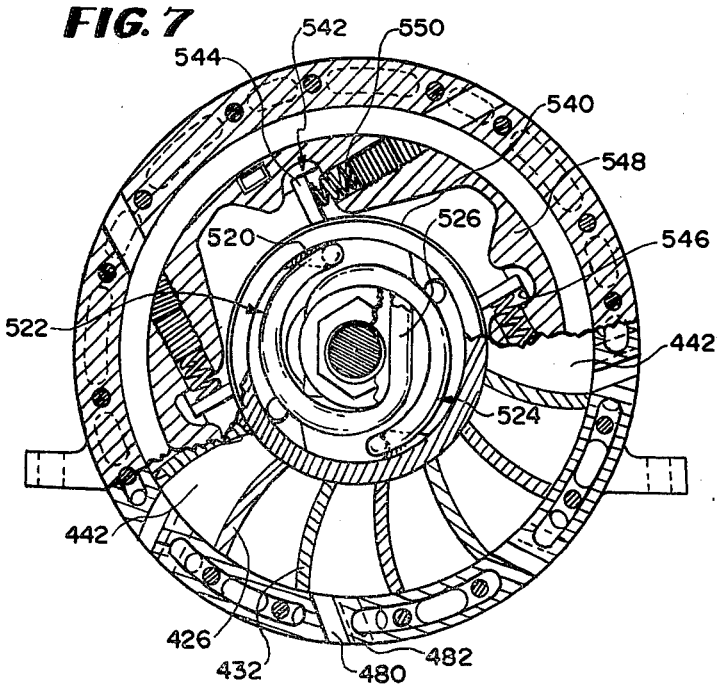
FIG. 7 is a sectional view taken along the lines 7—7 of FIG. 6 with certain of the parts broken away for clarity.

Referring to FIGS. 6 and 7, an alternative form of fluid motor device is illustrated in which an unique drive system is provided between the rotary elements and the output shaft. Like elements of the construction of FIGS. 6 and 7, carry like numerals to those of FIGS. 1–3 with the exception that they are provided with the prefix "4". In other words, they are in the 400 series. The fluid motor 410 of FIG. 6 operates in a manner similar to that described for FIG. 1 in that fluid pressure received through the input passages 480 will serve to alternately drive the rotary elements 416 and 418 in a forward direction to drive the output shaft 414. The hub 502, connected to element 418, has internal lugs 520 provided thereon which are engaged by a spring-steel drive member 522. Drive members 522 and 524 are provided each having an arm 525 driven by the lugs 520. The spring-steel drive members 522 and 524 have inner extending arms 526 engaged within bores 528 provided in drive lugs 530 attached to shaft 414. Thus, when the rotary element 418, for example, is driven in the forward direction it will drive arms 525 of springs 522 and 524 in the forward direction and through the medium of the springs drive shaft 414. It will be seen that the drive is very smooth in that the springs can flex slightly to avoid shocks within the system, but will yet adequately serve to drive the output shaft 414.

Also provided on the hub 502 is an external clutch race 540 which serves to act in connection with a one-way clutch mechanism 542 to hold rotary element 418 against rotation in the reverse direction in a manner similar to one-way clutch 302 of FIG. 4. One-way clutch 542 includes a plurality of wedging segments 544 mounted within a suitable bore 546 within a reaction plate 548 which is secured within casing 412. Coil springs 550 act on the wedging segments 544 urging them to the left as shown in FIG. 7 whereby when the inner race 540 attempts to rotate in the counter-clockwise direction, as shown in FIG. 7 for example, the wedging elements 544 being at an angle, will serve to prevent rotation in the counter-clockwise direction, holding the element 418 against rotation in the counter-clockwise direction. However, the element 418 can rotate in the clockwise direction since this will move the wedging elements 544 against the force of spring 550 in a releasing direction.

A similar type of one-way clutch, although not illustrated, will be provided for the rotary element 416, and will prevent reverse rotation of the element 416 when it is serving as a reaction element of the fluid motor.

The spring drive connection is not described in detail for the rotary element 416 since it is identical to that for rotary element 418, again employing a pair of spring driving members 522A and 524A.

Thus, it will be seen that fluid motor of FIGS. 6 and 7 is compact and provides a fluid drive to the output shaft 414. The drive will be smooth and devoid of vibrations since the drive is through spring-steel drive members which will absorb the shocks of the pressure pulses. Similar to the constructions of FIGS. 1–3 and 4 and 5, the fluid motor 410 of FIGS. 6 and 7 can likewise be used as an internal combustion engine by the provision of spark plugs to ignite the gas in chambers 442 at the proper time to drive the rotary elements in a forward direction.

I claim:

1. A rotary motor including a casing, a pair of rotatable vaned elements in the casing, a plurality of fluid chambers between said vaned elements, each of said vaned elements having vanes which intersperse with the vanes on the other element, means to admit gas under pressure into alternate of said chambers, means to exhaust gas from alternate of said chambers, an output shaft mounted internally of said vaned elements, flexible drive means between each of said vaned elements and said output shaft, reaction means operative to prevent relative reverse rotation of either of said vaned elements whereby gas pressure admitted will drive said vaned elements alternately in the same direction to drive said output shaft.

2. A mechanism as claimed in claim 1 wherein said flexible drive means comprises coil springs between said vaned elements and said output shaft.

3. A mechanism as claimed in claim 1 wherein said reaction means comprises a one-way clutch.

4. A mechanism as claimed in claim 1 including a planetary gear train between each of said vaned elements and said output shaft.

5. A mechanism as claimed in claim 4 wherein said reaction means includes holding means engageable with cam means on each of said vaned elements and said holding means being driven in a timed manner by a gear train between said reaction means and said output shaft.

6. A mechanism as claimed in claim 5 wherein said gear train includes an elliptical gear on said output shaft and an elliptical gear on said reaction means.

7. A rotary motor including a casing, a pair of rotatable vaned elements in the casing, a plurality of fluid chambers between said vaned elements, each of said vaned elements having vanes which intersperse with the vanes on the other element, means to admit gas under pressure into alternate of said chambers, means to exhaust gas from alternate of said chambers, an output shaft mounted internally of said vaned elements, flexible drive means connecting each of said vaned elements to a planetary gear train, said planetary gear train having output means connected to said output shaft, reaction means operative to prevent relative reverse rotation of either of said vaned elements whereby gas pressure admitted will drive said vaned elements alternately in the same direction to drive said output shaft.

8. A mechanism as claimed in claim 7 wherein said reaction means includes holding means engageable with cam means on each of said vaned elements and said holding means being driven in a timed manner by a gear train between said reaction means and said output shaft.

9. A mechanism as claimed in claim 7 wherein said flexible drive means comprises coil springs between said vaned elements and said output shaft.

10. A mechanism as claimed in claim 9 wherein said reaction means comprises a one-way clutch.

* * * * *